US008222975B2

(12) United States Patent
Ishizaki et al.

(10) Patent No.: US 8,222,975 B2
(45) Date of Patent: Jul. 17, 2012

(54) TRANSMISSION LINE RESONATOR, HIGH-FREQUENCY FILTER USING THE SAME, HIGH-FREQUENCY MODULE, AND RADIO DEVICE

(75) Inventors: Toshio Ishizaki, Hyogo (JP); Masaya Tamura, Osaka (JP)

(73) Assignee: Panasonic Corporation, Osaka (JP)

( * ) Notice: Subject to any disclaimer, the term of this patent is extended or adjusted under 35 U.S.C. 154(b) by 663 days.

(21) Appl. No.: 12/438,840

(22) PCT Filed: Aug. 28, 2007

(86) PCT No.: PCT/JP2007/066589

§ 371 (c)(1),
(2), (4) Date: Feb. 25, 2009

(87) PCT Pub. No.: WO2008/029662

PCT Pub. Date: Mar. 13, 2008

(65) Prior Publication Data

US 2010/0007445 A1 Jan. 14, 2010

(30) Foreign Application Priority Data

Aug. 31, 2006 (JP) ..... 2006-235243

(51) Int. Cl.
*H01P 7/08* (2006.01)

(52) U.S. Cl. ..... 333/219; 333/204

(58) Field of Classification Search ..... 333/165, 333/167, 168, 176, 185, 202, 204, 205, 219, 333/235

See application file for complete search history.

(56) References Cited

U.S. PATENT DOCUMENTS

| | | | | |
|---|---|---|---|---|
| 5,922,650 | A * | 7/1999 | Ye | 505/210 |
| 6,144,268 | A | 11/2000 | Matsui et al. | |
| 6,941,650 | B2 * | 9/2005 | Nakakubo et al. | 29/849 |
| 7,215,007 | B2 * | 5/2007 | McKinzie et al. | 257/664 |
| 7,391,288 | B1 * | 6/2008 | Itoh et al. | 333/219 |
| 7,446,712 | B2 * | 11/2008 | Itoh et al. | 343/700 MS |
| 7,764,232 | B2 * | 7/2010 | Achour et al. | 343/700 MS |
| 7,911,386 | B1 * | 3/2011 | Itoh et al. | 343/700 MS |
| 7,952,526 | B2 * | 5/2011 | Lee et al. | 343/700 MS |
| 2005/0012566 | A1 * | 1/2005 | Kushitani et al. | 333/175 |

(Continued)

FOREIGN PATENT DOCUMENTS

EP 1658969 5/2006

(Continued)

OTHER PUBLICATIONS

Park et al., "A Novel Planar Left-Handed Transmission Line using Grounded Rectangular Patch with Meander Line", Antennas & Propagation Society International Symposium 2006, Jul. 9-14, 2006, pp. 4141-4144.*

(Continued)

*Primary Examiner* — Seungsook Ham
(74) *Attorney, Agent, or Firm* — Wenderoth, Lind & Ponack, L.L.P.

(57) ABSTRACT

A transmission line type resonator has a low-loss characteristic and, in order to realize the low-loss characteristic, the transmission line type resonator includes a laminate body formed of a plurality of dielectric sheets, a transmission line of complex right hand left hand system disposed between the plurality of dielectric sheets, and an external connection terminal disposed at the end face of the transmission line type resonator and connected with the transmission line of complex right hand left hand system.

19 Claims, 22 Drawing Sheets

U.S. PATENT DOCUMENTS

| | | | |
|---|---|---|---|
| 2006/0066422 | A1 | 3/2006 | Itoh et al. |
| 2006/0109606 | A1 | 5/2006 | Wang et al. |
| 2006/0145805 | A1 | 7/2006 | Kim et al. |

FOREIGN PATENT DOCUMENTS

| | | |
|---|---|---|
| JP | 2-299308 | 12/1990 |
| JP | 8-56101 | 2/1996 |
| JP | 2003-133882 | 5/2003 |
| JP | 2004-221388 | 8/2004 |
| JP | 2005-51331 | 2/2005 |
| JP | 2007-174519 | 7/2007 |

OTHER PUBLICATIONS

Sanada et al., "A Via-Free Microstrip Left-Handed Transmission Line", Microwave Symposium Digest, 2004 IEEE MTT-S International, Jun. 6-11, 2004, pp. 301-304.*

Mao et al., "Equivalent circuit modeling of symmetric Composite Right/Left-handed coplanar waveguides", Microwave symposium Digest, 2005 IEEE MTT-S International, Jun. 12-17, 2005, pp. 1953-1956.*

International Search Report issued Dec. 11, 2007 in the International (PCT) Application No. PCT/JP2007/066589 of which the present application is the U.S. National Stage.

Sanada, A. et al., "A Microstrip Composite Right/Left-Handed Transmission Line without Vias", *IEICE Technical Report*, (2004), 103(561): pp. 7-12.

Matthaei, G. L. et al., "*Microwave Filters, Impedance-Matching Networks, and Coupling Structures*", Artech House Publishers, Feb. 1980, pp. 97-104.

Supplementary European Search Report Issued Jun. 17, 2009 in corresponding European Application No. 07 79 3041.

Y. Horii et al., "Super-Compact Multilayered Left-Handed Transmission Line and Diplexer Application," IEEE Transactions on Microwave Theory and Techniques, vol. 53, No. 4, Apr. 2005, pp. 1527-1534.

A. Sanada et al., "Novel Zeroth-Order Resonance in Composite Right/Left-Handed Transmission Line Resonators," Proceedings 2003 Asia-Pacific Microwave Conference, Nov. 4, 2003-Nov. 7, 2003.

W. Cho et al., "Enhancement of electric field inside metallodielectric metamaterial," Advanced Materials Research, vol. 11-12, pp. 117-120, 2006, and Asian International Conference on Advanced Materials, Nov. 3, 2005-Nov. 5, 2005.

Y. Horii et al., "Vertical Multi-Layered Implementation of a Purely Left-Handed Transmission Line for Super-Compact and Dual-Band Devices," 34$^{TH}$ European Microwave Conference, vol. 1, Oct. 2004, pp. 471-473.

* cited by examiner

FIG. 24 - PRIOR ART
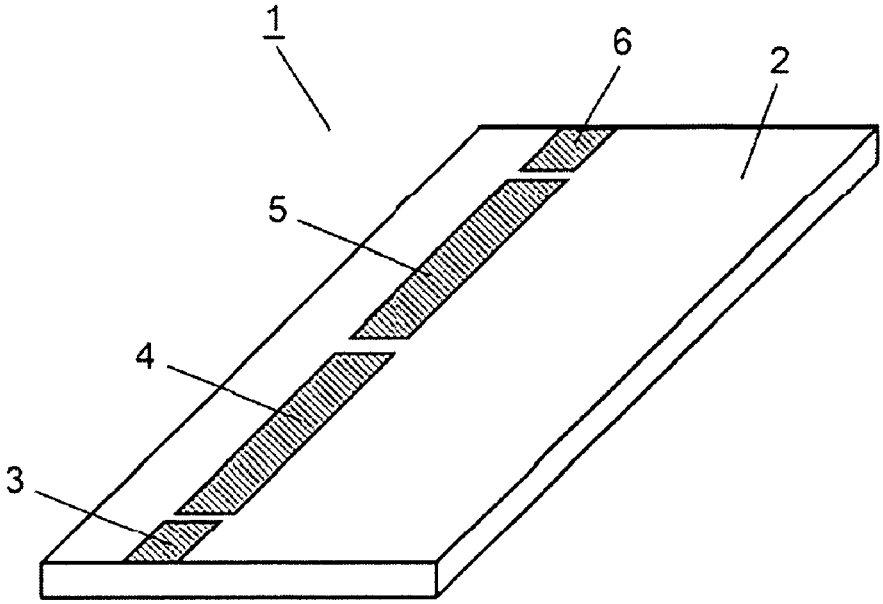

TRANSMISSION LINE RESONATOR, HIGH-FREQUENCY FILTER USING THE SAME, HIGH-FREQUENCY MODULE, AND RADIO DEVICE

This application is a U.S. National Phase Application of PCT International Application PCT/JP2007/066589, filed Aug. 28, 2007.

TECHNICAL FIELD

The present invention relates to a high frequency filter and a transmission line type resonator used in portable telephone units, digital TV tuners and the like wireless apparatus, as well as in high frequency modules.

BACKGROUND ART

A high frequency filter which contains a conventional transmission line type resonator is described referring to drawings. FIG. 24 is a perspective view of a high frequency filter which contains a conventional transmission line type resonator.

Referring to FIG. 24, conventional high frequency filter 1 includes terminal 3 for external connection, half-wavelength transmission line type resonator 4, half-wavelength transmission line type resonator 5, and terminal 6 for external connection, which are disposed in the order of above description on dielectric sheet 2. These terminal 3 for external connection, transmission line type resonator 4, transmission line type resonator 5, and terminal 6 for external connection are in the state of capacitive coupling to each other.

The element length of transmission line type resonators 4, 5 in the conventional high frequency filter 1 is determined depending on the dielectric constant of dielectric sheet 2.

As to the prior art technical documentation related to the present patent application, "MICROWAVE FILTERS, IMPEDANCE-MATCHING NETWORKS, AND COUPLING STRUCTURES" by G. L. Matthaei, L. Young and E. M. T. Jones, Artech House (Norwood, Mass.) 1980, offers known information.

In the above-described conventional high frequency filter 1, whose transmission line type resonators 4, 5 are of the right hand system, the electric resistance of transmission line type resonators 4, 5 converts the high frequency current in transmission line type resonators 4, 5 into thermal energy. This results in a substantial insertion loss in the transmission characteristic of high frequency filter 1.

SUMMARY OF THE INVENTION

The present invention aims to offer a low-loss transmission line type resonator.

A transmission line type resonator in the present invention is formed of a laminate body consisting of a plurality of dielectric sheets. A transmission line of complex right hand left hand system is disposed between the plurality of dielectric sheets, and an external connection terminal coupled with the transmission line of complex right hand left hand system is provided at the end face of transmission line type resonator.

Since the above-structured transmission line type resonator in the present invention is provided with a transmission line of complex right hand left hand system, the resonator demonstrates a low-loss characteristic.

BRIEF DESCRIPTION OF THE DRAWINGS

FIG. 24 shows the perspective view of a high frequency filter which contains a conventional transmission line type resonator.

DETAILED DESCRIPTION OF PREFERRED EMBODIMENTS

First Exemplary Embodiment

Figure 1:
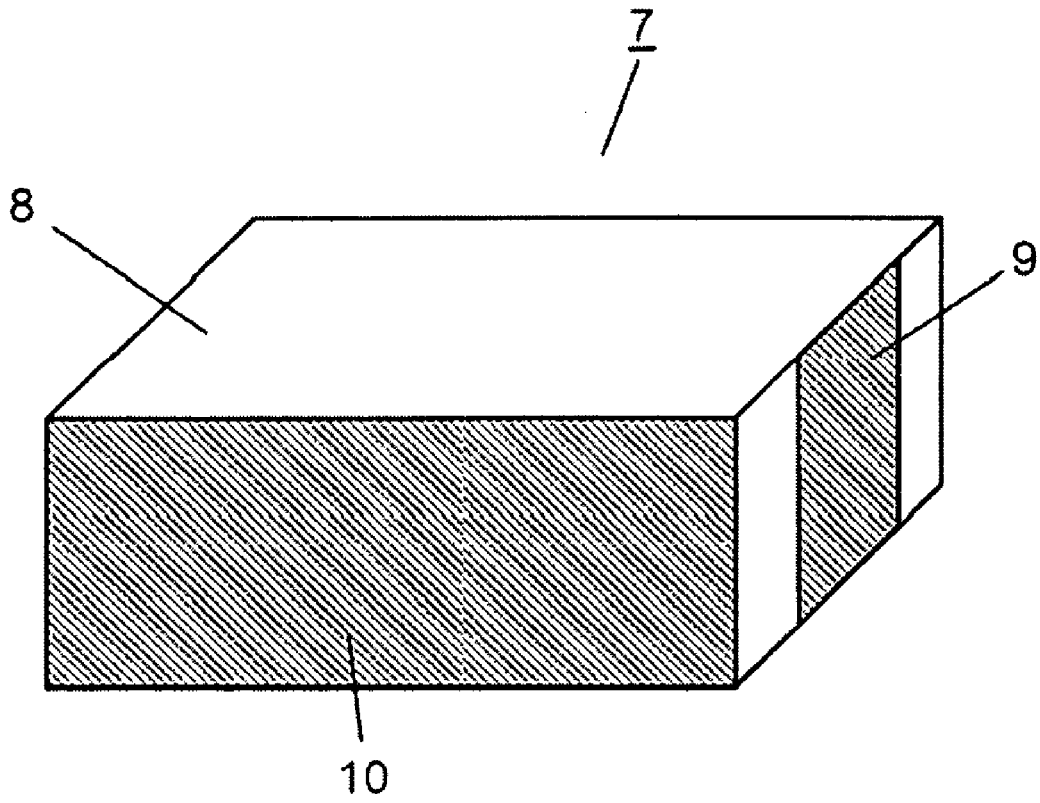
FIG. 1 shows the overall appearance of a transmission line type resonator in accordance with a first exemplary embodiment of the present invention.

A transmission line type resonator is described in accordance with a first exemplary embodiment of the present invention referring to the drawings.

FIG. 1 shows the appearance of transmission line type resonator in the first embodiment.

Referring to FIG. 1, transmission line type resonator 7 includes laminate body 8, external connection terminal 9 disposed on the end face of laminate body 8, and grounding electrode 10.

Figure 2:
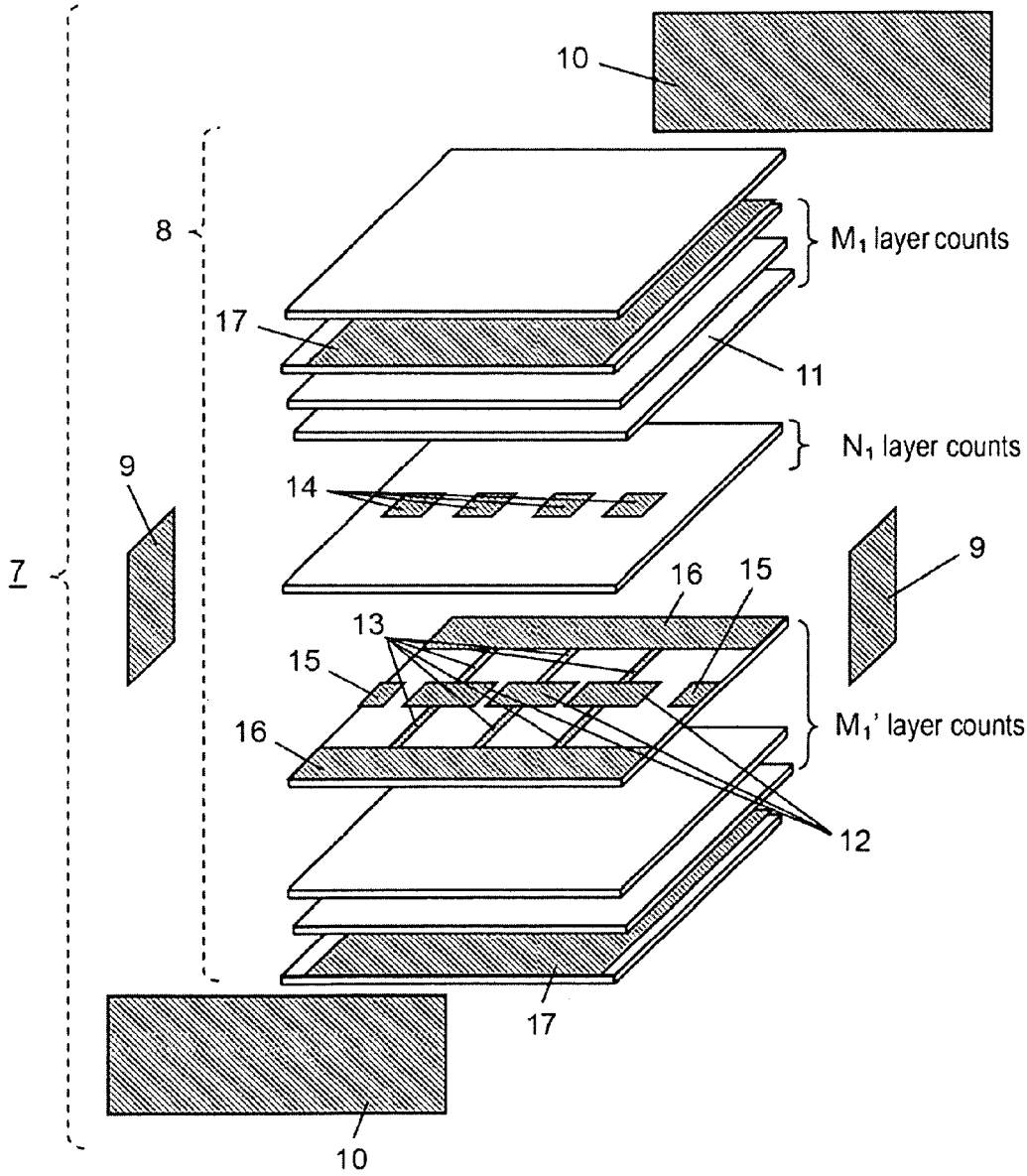
FIG. 2 is an exploded perspective view of the transmission line type resonator.

FIG. 2 is an exploded perspective view of the transmission line type resonator, which is of complex right hand left hand system, according to the first embodiment. Transmission line type resonator 7 of complex right hand left hand system is formed by laminating a plurality of dielectric sheets 11 made of either a low temperature co-fired ceramic material or a resin material. On a certain dielectric sheet 11, a plurality of line electrodes 12 is provided in a straight line arrangement with an optional space between each other.

Line electrode 12 is connected with grounding pattern electrode 16 by way of inductive connection pattern electrode 13 whose line width is smaller than that of line electrode 12. Grounding pattern electrode 16 is coupled with grounding electrode 10.

On the dielectric sheet 11 which is locating above line electrode 12, a plurality of capacitance electrodes 14 is provided so as they are opposed to line electrodes 12. Each of the respective capacitance electrodes 14 is located so as to bridge over the two adjacent line electrodes 12 in order to bring the adjacent line electrodes 12 into a state of capacitive coupling. Input/output pattern electrode 15 is disposed so as to realize capacitive coupling with the outermost line electrode 12 among the plurality of line electrodes. Input/output pattern electrode 15 is coupled with the above-described external connection terminal 9.

Shield pattern electrode 17 is provided at the lower surface of the uppermost dielectric sheet 11 and at the upper surface of the lowermost dielectric sheet 11 of laminate body 8. These two shield pattern electrodes 17 are also connected with grounding electrode 10.

Thus, a transmission line of complex right hand left hand system in the present invention is structured of at least the above-described grounding electrode 10, line electrode 12, connection pattern electrode 13 and input/output pattern electrode 15.

Now, the operations of a conventional transmission line of right hand system, an ideal transmission line of left hand system and a transmission line of complex right hand left hand system in the present invention are described below.

Figure 3A:
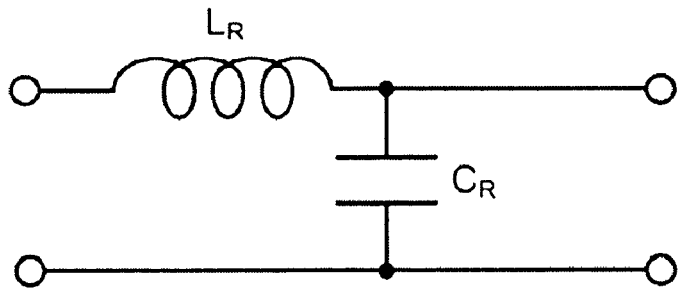
FIG. 3A is an equivalent circuit diagram representing a conventional transmission line of right hand system (PRH) in the micro sector.

FIG. 3A is an equivalent circuit diagram representing a conventional transmission line of right hand system (PRH) in the micro sector. In the conventional transmission line of right hand system, inductor $L_R$ is connected in series while capacitor $C_R$ is connected in parallel. Here, both the dielectric constant and the coefficient of magnetic permeability naturally bear the positive values.

Figure 3B:
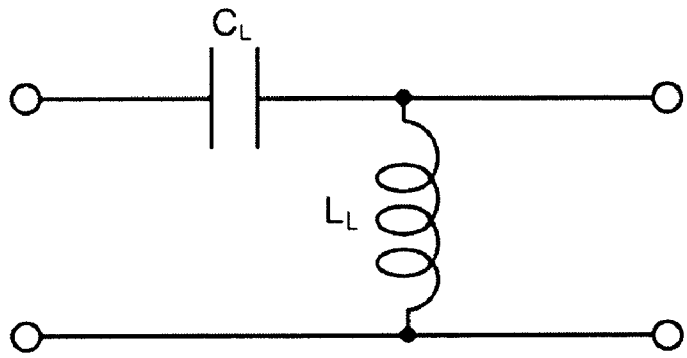
FIG. 3B is an equivalent circuit diagram representing an ideal transmission line of left hand system (PLH) in the micro sector.

FIG. 3B is an equivalent circuit diagram representing an ideal transmission line of left hand system (PLH) in the micro sector. In an ideal transmission line of left hand system, capacitor $C_L$ is connected in series while inductor $L_L$ is connected in parallel. In this case, both the dielectric constant and the coefficient of magnetic permeability bear the negative values. Therefore, its electrical behavior is significantly different from that of the natural transmission lines. For example, it generates a retrogressive wave. The retrogressive wave refers to a wave where wave energy proceeds in the direction opposite to the phase proceeding direction. Also, it generates a low speed wave. As the result, the wave phase proceeding speed becomes very slow as compared to that in the free space. Therefore, the length of transmission line type resonator can be reduced even in low frequency.

Figure 3C:
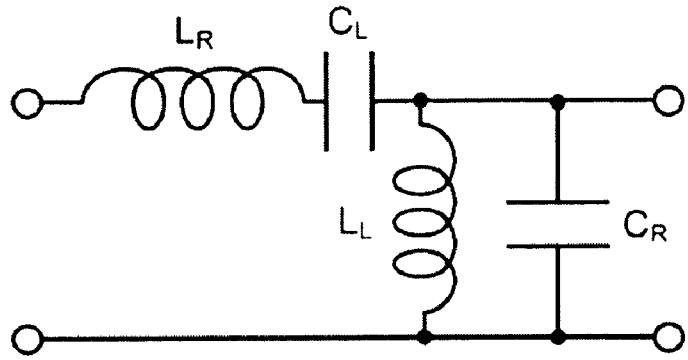
FIG. 3C is an equivalent circuit diagram representing a transmission line of complex right hand left hand system (CRLH) in the micro sector.

FIG. 3C is an equivalent circuit diagram which represents a transmission line of complex right hand left hand system (CRLH) in the micro sector. Even if an ideal transmission line of left hand system shown in FIG. 3B is targeted, the series inductor and parallel capacitor, which are intrinsic to the right hand system, parasitically appear parasitically. Eventually, it turns out to be a transmission line of complex right hand left hand system as shown in FIG. 3C. A transmission line of complex right hand left hand system demonstrates the characteristics of left hand system in the region 0~$\omega_{sh}$, while in the region $\omega_{se}$~$\infty$ it demonstrates those of right hand system. In the case where $\omega_{sh} \neq \omega_{se}$, it is called an unbalance type; the wave is unable to propagate at the frequency (unbalance GAP). Whereas, in the case where $\omega_0 = \omega_{sh} = \omega_{se}$, it is called the balance type; in the frequency lower than $\omega_0$ it exhibits the features of left hand system, while in the frequency higher than $\omega_0$ it exhibits the features of right hand system. The relationship of the respective frequencies $\omega_0$, $\omega_{sh}$, $\omega_{se}$, versus phase propagation constant $\beta_p$ is shown in FIG. 4.

Figure 4:
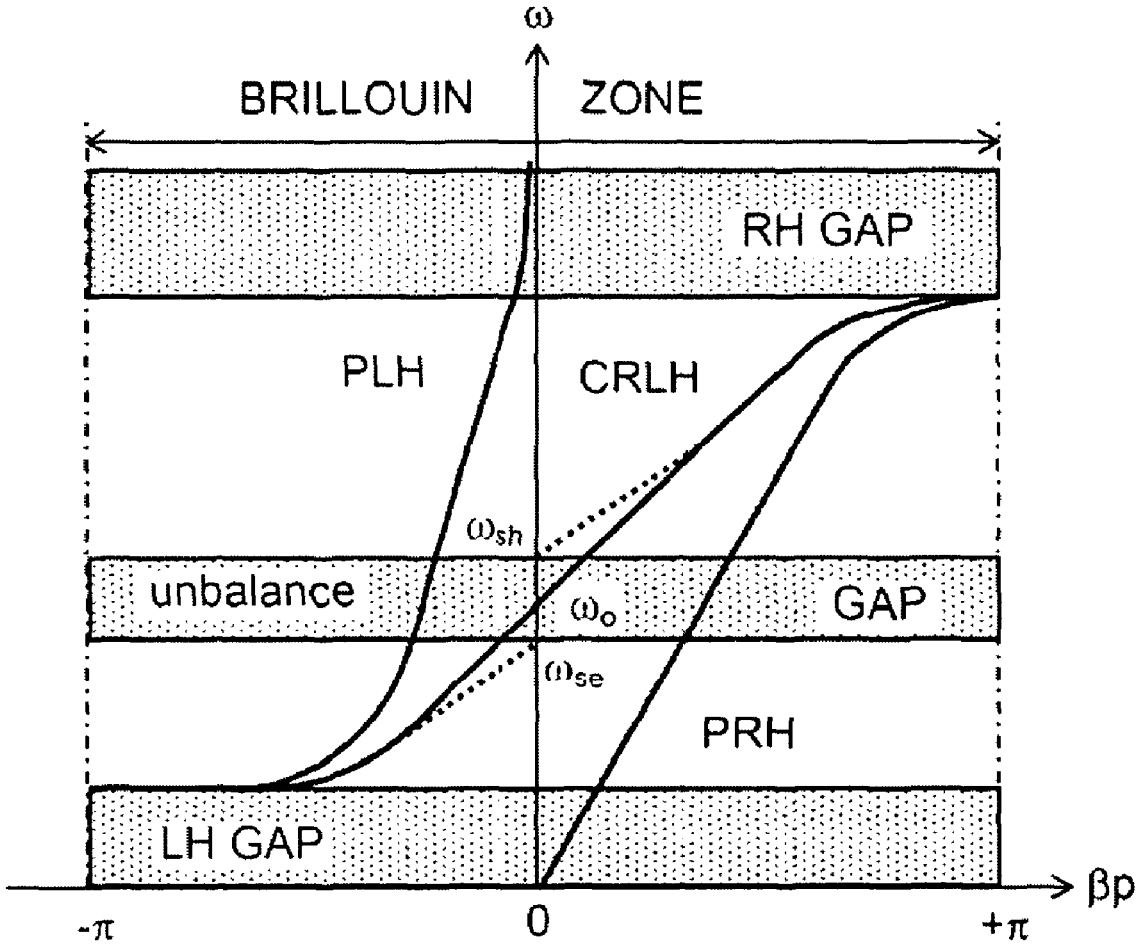
FIG. 4 is a chart used to show the relationship of phase propagation constant $\beta_p$ versus respective frequencies $\omega_0$, $\omega_{sh}$, $\omega_{se}$.

FIG. 4 shows the relationship of the respective frequencies ω0, ωsh, ωse versus phase propagation constant βp. In FIG. 4, the vertical axis indicates the angular frequency, while the horizontal axis the phase propagation constant. The uprising PRH from the bottom left to the top right is means that the higher the frequency, the more the phase revolution. On the other hand, the descending PLH from the top right to the bottom left means that the lower the frequency, the more the phase revolution. Namely, in the left hand system, the wavelength goes shorter along with the lowering frequency.

In a transmission line type resonator of the present invention, any of those frequencies on the characteristic curve of a transmission line of complex right hand left hand system (CRLH) can be used; however, in a region where $\beta_p$ is negative, it provides the characteristic that was not available before. Especially, at $\omega = \omega_0$, the wavelength becomes infinity, making the overall length of transmission line type resonator irrelevant to the wavelength. Theoretically, the length of a resonator can be reduced down to any desired size. This is called the resonator of zero dimensional order. In other words, it is the most favorable resonance mode in the present invention. When, the resonance frequency is determined by parallel resonance frequency of $C_R$ and $L_L$.

Now, the loss in a transmission line type resonator is contemplated. Generally speaking, the loss consists of a loss due to resistance caused by conductor resistance of the transmission line, and a loss by dielectric body due to tan δ of the dielectric body. In a conventional transmission line of right hand system, the loss due to line resistance is dominating. In the case of a transmission line of left hand system, where the line is formed of series connection of series capacitor $C_L$, as shown also in FIG. 3B, hardly any resistance loss is caused in this part. Although there still remains a resistance due to parallel inductor $L_L$, the parallel circuit is used at parallel resonance frequency where the impedance is infinite; so, any influence caused by the resistance loss is hardly observed, especially in the case of a zero-order resonator.

Consequently, the line length can be reduced remarkably in a zero-order resonator as compared to that in a conventional transmission line type resonator of right hand system. Furthermore, a higher no-load Q value is yielded. Namely, the loss can be reduced.

It is preferred to provide the entire dielectric sheets 11 controlled to substantially the same thickness. Dielectric sheets 11 thus specified to the same thickness would facilitate easy manufacturing operation and cost reduction.

From the view point of loss reduction, it is further preferred to design the number of dielectric sheets 11 as follows: $M_1$, $M_1'>N_1$ where;

$N_1$ ($N_1$ is a natural number) signifies the number of dielectric sheets 11 disposed between capacitance electrode 14 and line electrode 12, $M_1$ ($M_1$ is a natural number) signifies the number of dielectric sheets 11 between the upper shield pattern electrode 17 and capacitance electrode 14, and $M_1'$ ($M_1'$ is a natural number) signifies the number of dielectric sheets 11 between line electrode 12 and lower shield pattern electrode 17.

Figure 5:
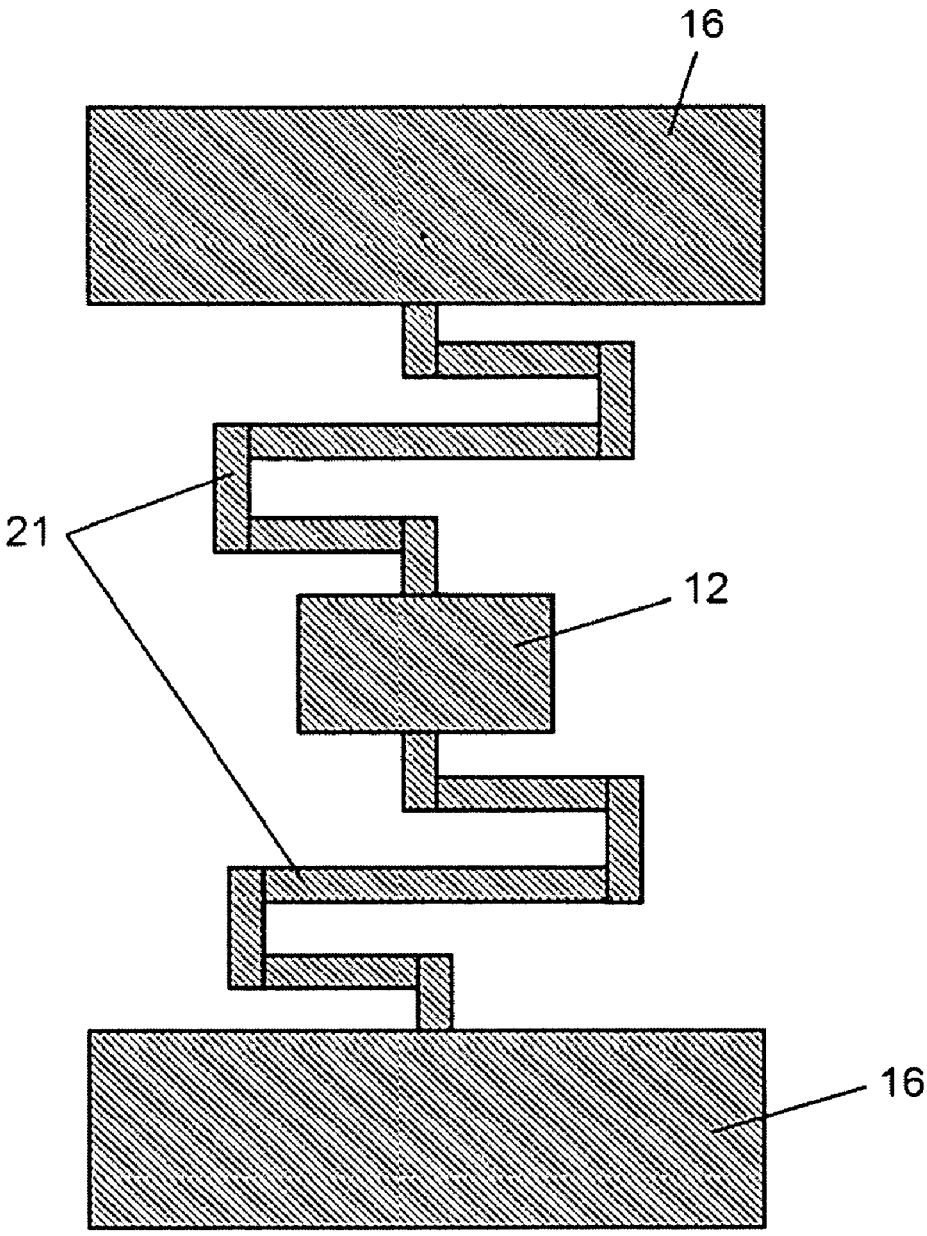
FIG. 5 shows an example of a meandering line connection pattern electrode.
Figure 6A:
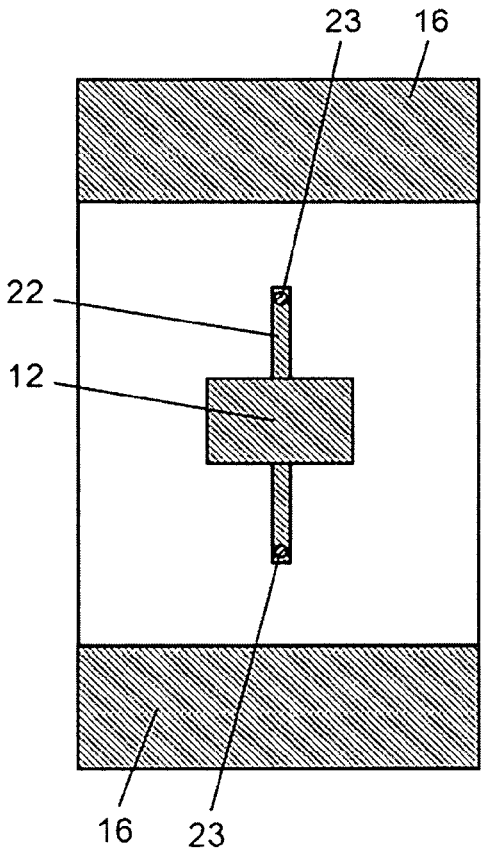
FIG. 6A shows the upper surface of a dielectric sheet provided with a spiral coil connection pattern electrode.
Figure 6B:
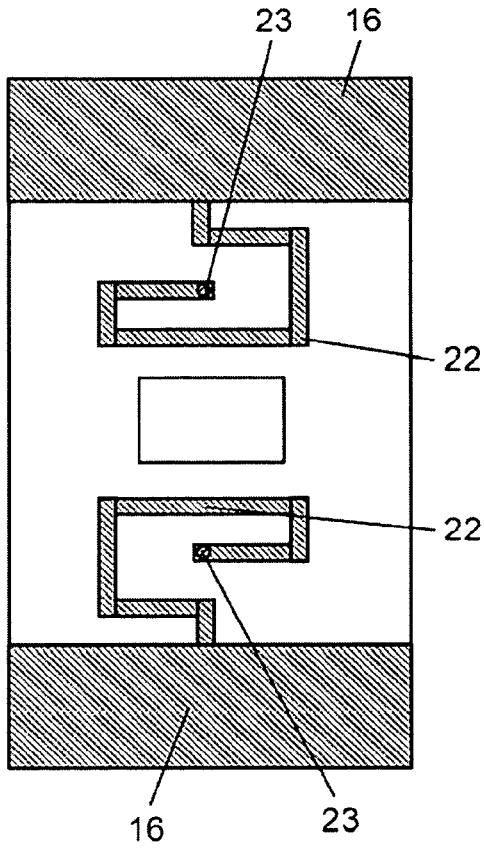
FIG. 6B shows the upper surface of a dielectric sheet located under the dielectric sheet of FIG. 6A.

Connection pattern electrode 13 can be provided in various ways. FIG. 5 illustrates an example which has a meandering line 21. The meandering line means a line having a plurality of bent portions as exemplified in FIG. 5. FIG. 6A and FIG. 6B show connection pattern electrode 13 of a spiral coil 22. FIG. 6A shows the upper surface of a certain specific dielectric sheet 11, while FIG. 6B shows the upper surface of dielectric sheet 11 which is placed under the above-described dielectric sheet 11. As shown in FIGS. 6A and 6B, spiral coil 22 is connected by means of via hole electrode 23. The use of spiral coil 22 offers a possibility for greater inductance, which would provide more freedom in technical designing.

(A Modification of the First Embodiment)

Figure 7:
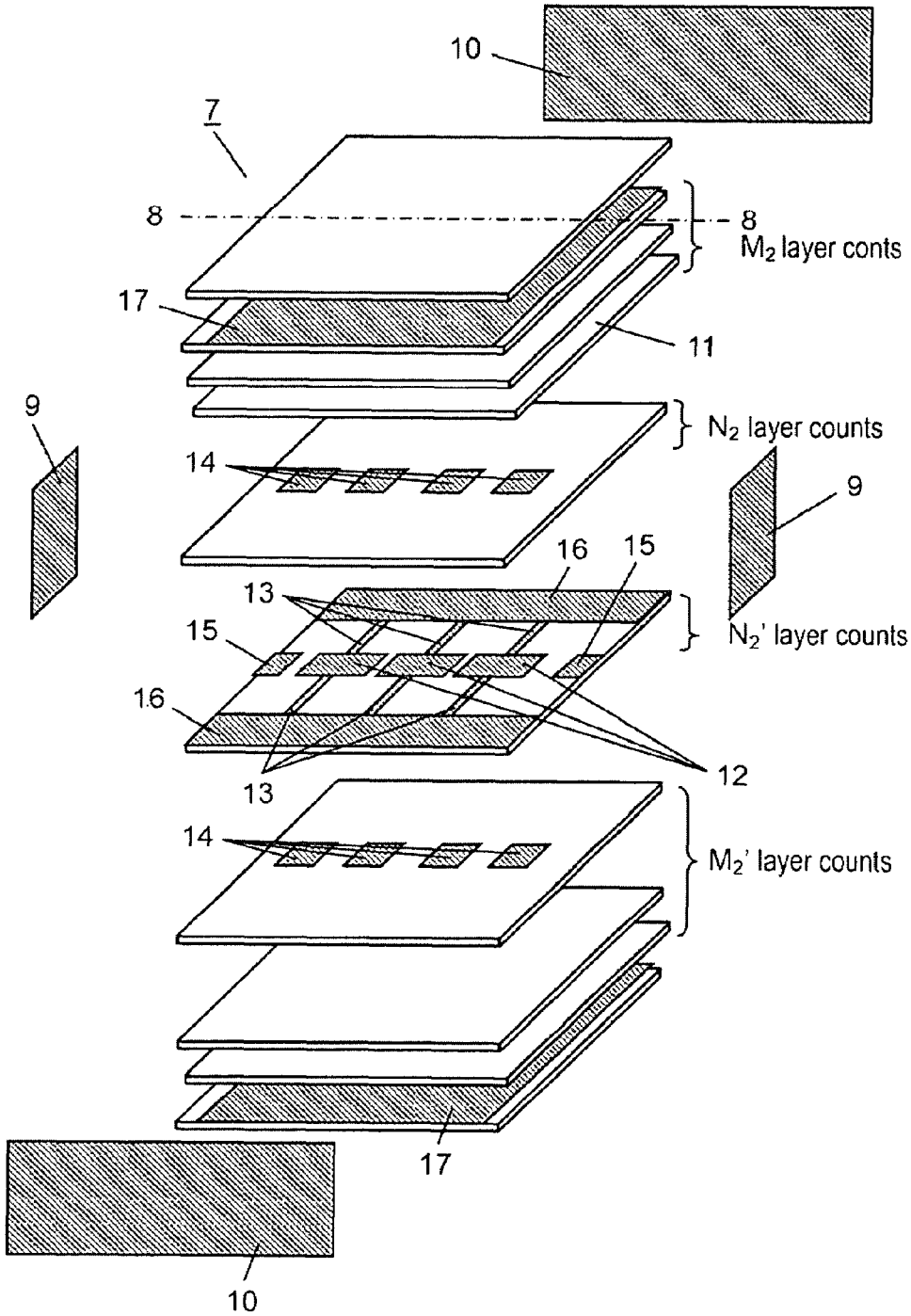
FIG. 7 is an exploded perspective view showing a modification of the transmission line type resonator according to the first embodiment.
Figure 8:
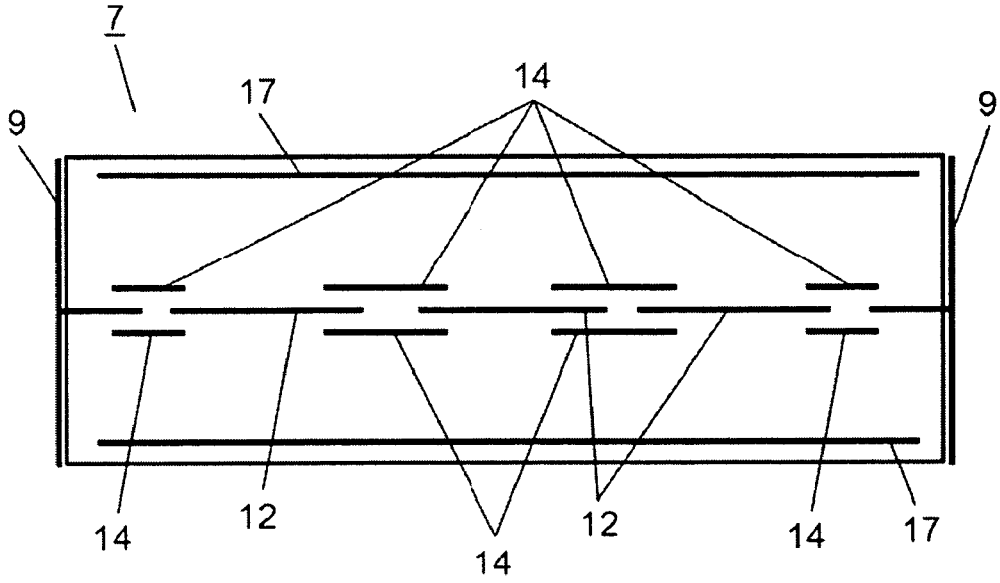
FIG. 8 is a cross sectional view showing the modification of transmission line type resonator according to the first embodiment.

FIG. 7 is an exploded perspective view which shows a modification of the first embodiment. The point of difference from the first embodiment is that capacitance electrode 14 is provided for two layers, viz. above and underneath line electrode 12. The structure enables the provision of a still greater coupling capacitance, which would allow a higher degree of designing freedom. FIG. 8 is a cross sectional view of the modification of the first embodiment shown in FIG. 7, sectioned along the line 8-8.

The number of capacitance electrodes 14 is not limited to two layers, above and underneath the line electrode 12; but, the capacitance electrode may be provided for two or more of layers.

The location of external connection terminal 9 is not limited to the end face of laminate body 8. Instead of the end face of laminate body 8, or in addition to the end face, the external connection terminal may be disposed on the upper surface or the bottom surface, or on both the upper and the bottom surfaces of laminate body 8. The above-described arrangements of external connection terminal 9 would make the surface mounting easier.

Second Exemplary Embodiment

Figure 9:
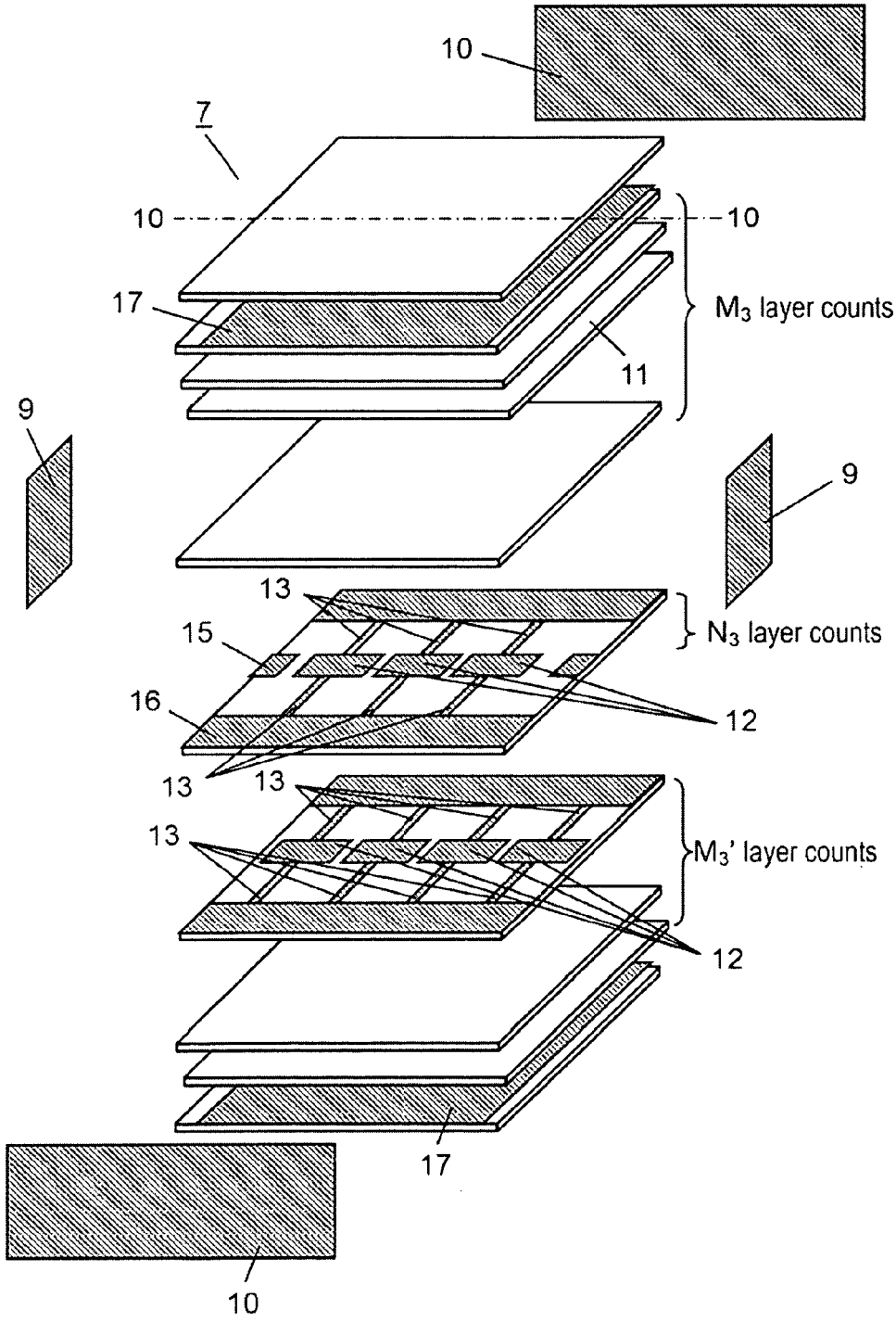
FIG. 9 is an exploded perspective view which shows a transmission line type resonator in accordance with a second exemplary embodiment of the present invention.
Figure 10:
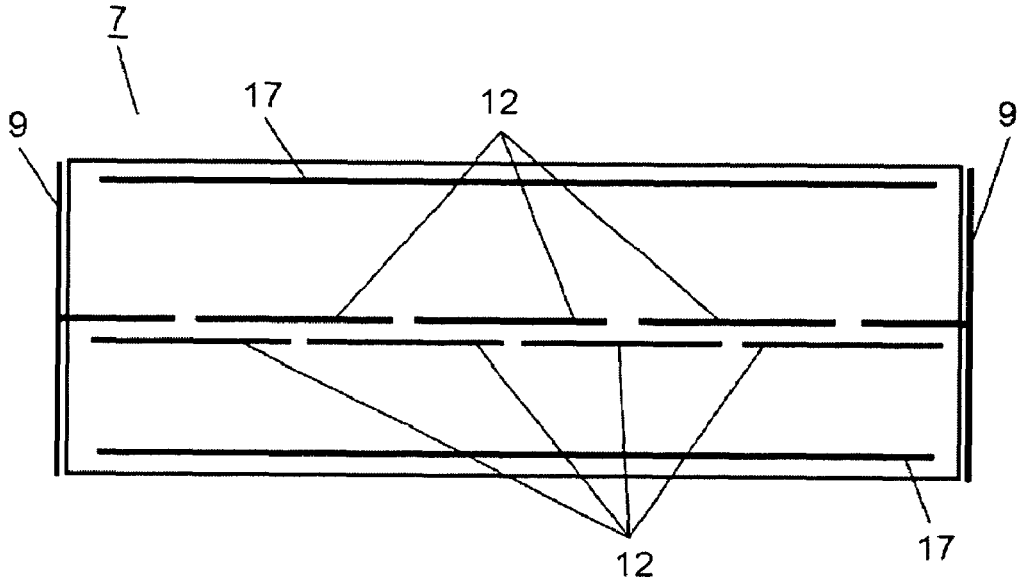
FIG. 10 is a cross sectional view showing the transmission line type resonator according to the second embodiment.

A transmission line type resonator of complex right hand left hand system is described in the structure in accordance with a second embodiment of the present invention. Unless otherwise described, those portions designated with the same numerals as in the first embodiment have the same structure and operate the same as the transmission line type resonator of the first embodiment; so, description of such portions is eliminated. FIG. 9 shows an exploded perspective view of a transmission line type resonator of complex right hand left hand system in accordance with the second embodiment. FIG. 10 is the cross sectional view, sectioned along the line 10-10.

Capacitance electrode 14 is eliminated in the second embodiment; instead, line electrode 12 is provided for two layers, with the location shifted so that the respective line electrodes are placed alternately. By so doing, the capacitive coupling is produced between the opposing line electrodes 12.

The above-described structure enables further reduction in the size of the transmission line type resonator 7 of complex right hand left hand system.

Third Exemplary Embodiment

Figure 11:
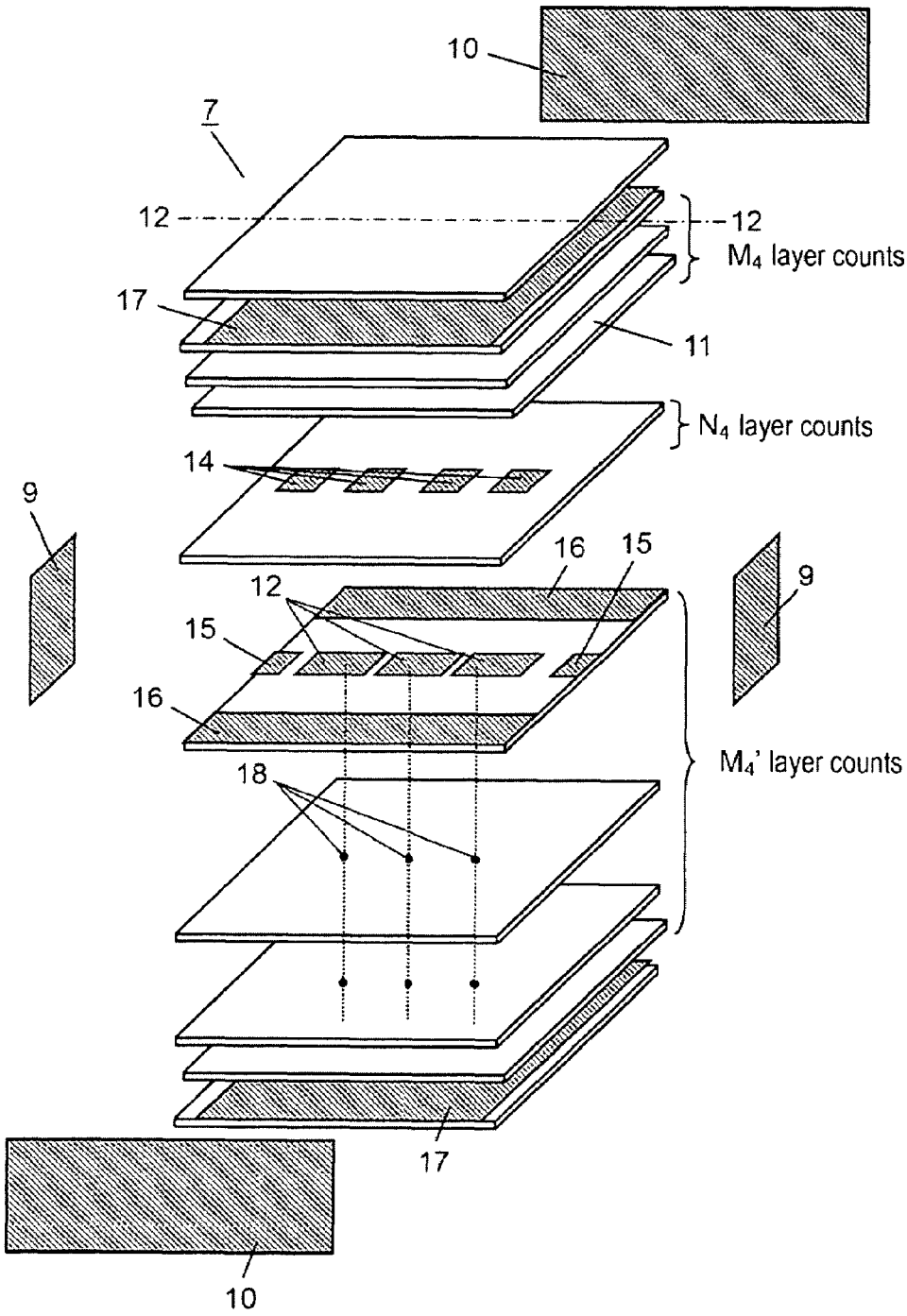
FIG. 11 is an exploded perspective view which shows a transmission line type resonator in accordance with a third exemplary embodiment of the present invention.
Figure 12:
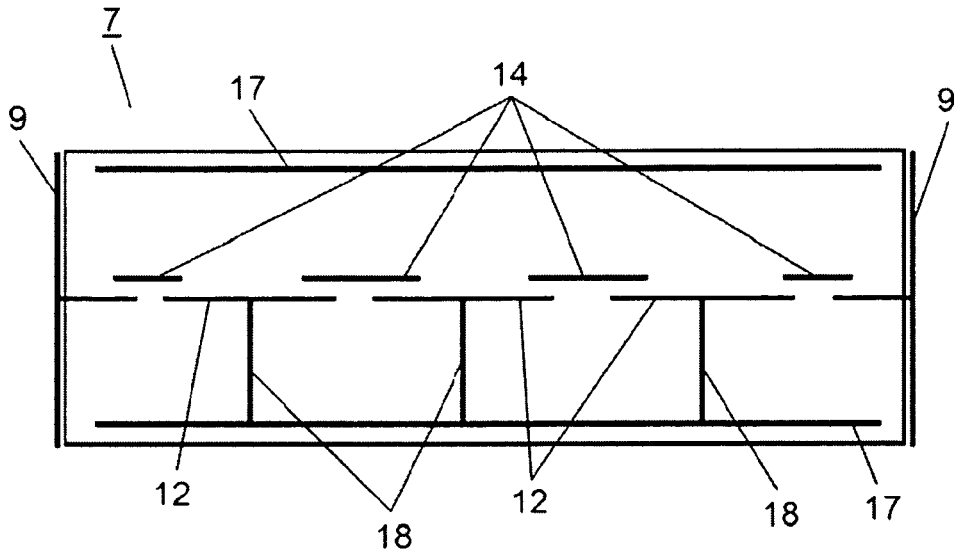
FIG. 12 is a cross sectional view showing the transmission line type resonator according to the third embodiment.

The structure of a transmission line type resonator of complex right hand left hand system is described in accordance with a third embodiment of the present invention. Unless otherwise described, those portions designated with the same numerals as in the first embodiment have the same structure and operate the same as the transmission line type resonator of the first embodiment; so, description of such portions is eliminated. FIG. 11 shows an exploded perspective view of transmission line type resonator 7 of complex right hand left hand system in accordance with the third embodiment. FIG. 12 shows the cross sectional view, sectioned along the line 12-12.

In the third embodiment, line electrode 12 is grounded to shield pattern electrode 17 by means of via hole electrode 18, instead of connection pattern electrode 13. Via hole electrode 18 works as parallel inductor $L_L$. Grounding pattern electrode 16 can be eliminated. The above structure enables reduction in the width of transmission line type resonator 7.

Figure 13:
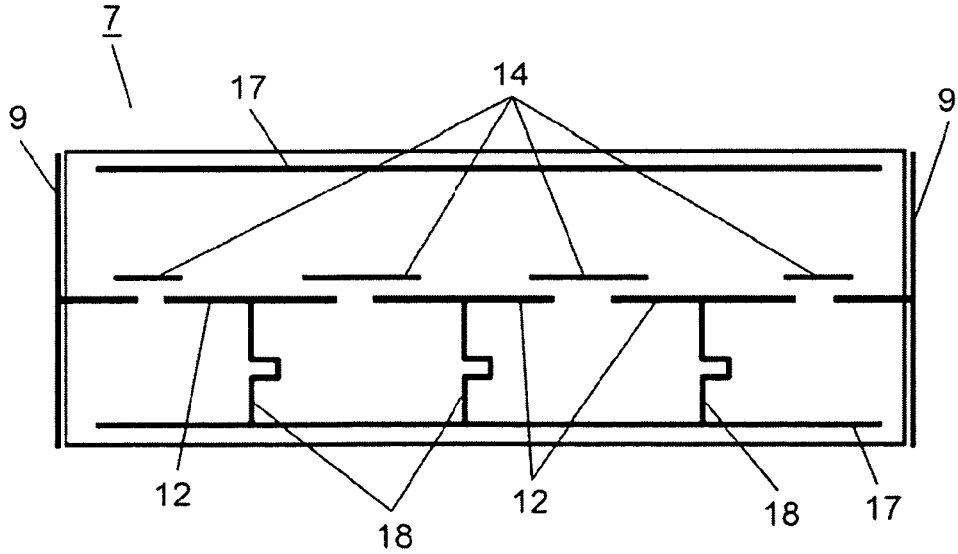
FIG. 13 shows an example according to the third embodiment where a via hole electrode is provided with a stub electrode.

Via hole electrode 18 may have various modifications. Shown in FIG. 13 is an example of a modification, where via hole electrode 18 is provided in the middle with a stub electrode. This enables production of a greater inductance; hence, there will be an increased freedom of designing.

Figure 14A:
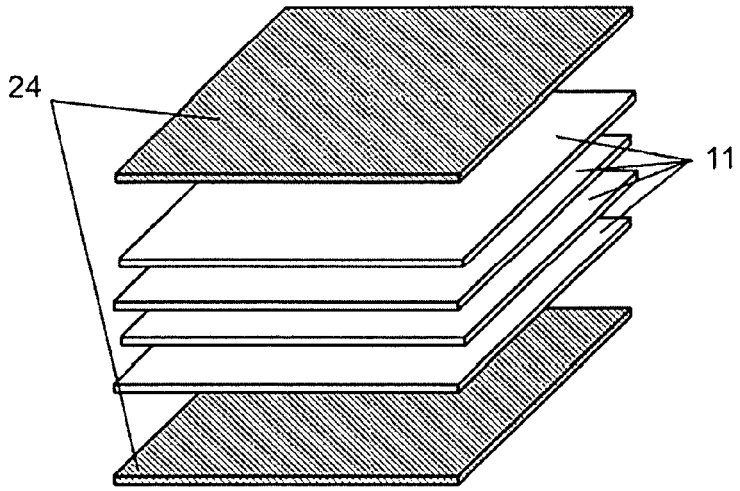
FIG. 14A is an exploded perspective view of the transmission line type resonator according to the third embodiment used to show a layer structure for non-shrink firing.
Figure 14B:
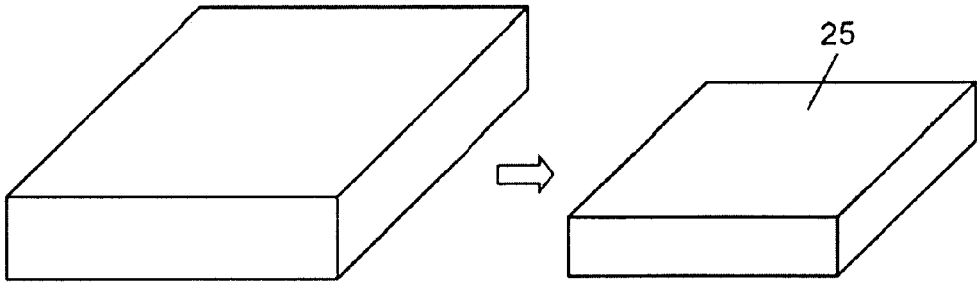
FIG. 14B shows the appearance of the transmission line type resonator according to the third embodiment, before and after the shrink firing.

In the case where laminate body 8 is formed by LTCC (Low Temperature Cofired Ceramics), there are two methods for firing laminate body 8, viz. shrink firing and non-shrink firing. FIG. 14A is an exploded perspective view showing the layer structure for non-shrink firing. Restriction layer 24 is attached to the uppermost layer and the lowermost layer of laminar dielectric sheets 11. FIG. 14B shows the appearance of shrink fired laminate body 25, before firing (left) and after firing (right). In the shrink firing, it shrinks by approximately 15% in each of the 3-dimensional directions.

Figure 14C:
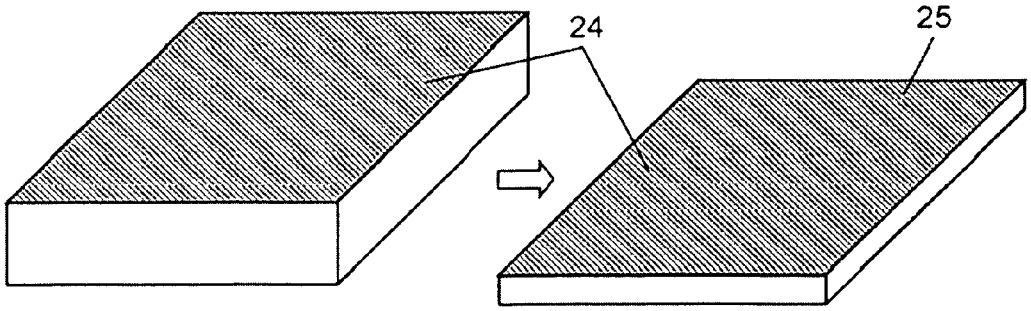
FIG. 14C shows the appearance of the transmission line type resonator according to the third embodiment, before and after the non-shrink firing.

In the non-shrink firing, there is no shrinkage observed in the plane direction; it shrinks only in the direction of thickness by approximately 50% as shown in FIG. 14C. Thus the non-shrink firing results in dispersion in the direction of thickness, while it ensures a high dimensional accuracy in the plane direction. So, when designing via hole electrode 18, the dispersion in the thickness direction has to be taken into account. Restriction layer 24 is removed after the firing is finished.

Figure 15:
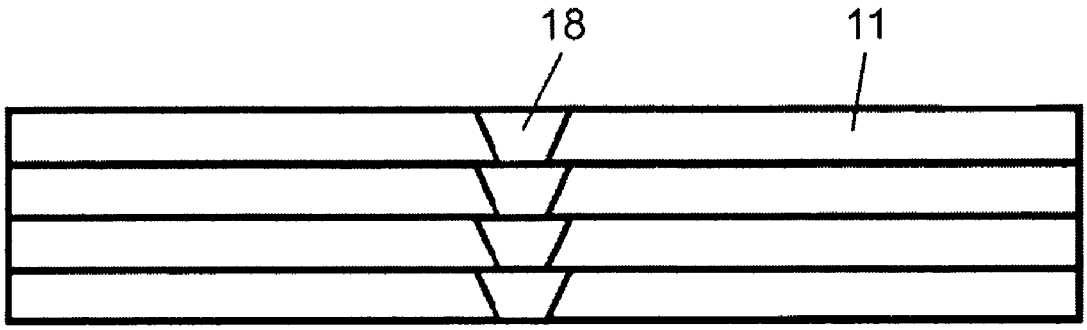
FIG. 15 is a magnified cross sectional view of a via hole electrode of the transmission line type resonator according to the third embodiment.

A detailed observation of via hole electrode 18 in its cross section revealed that the via hole has a tapered shape, narrower towards the bottom, at each of the respective dielectric sheets 11, as shown in FIG. 15. These are to be taken into account at the designing stage.

Fourth Exemplary Embodiment

A transmission line type resonator of complex right hand left hand system is described in accordance with a fourth embodiment of the present invention. Unless otherwise described, those portions designated with the same numerals as in the first embodiment have the same structure and operate the same as the transmission line type resonator of the first embodiment; so, description of such portions is eliminated.

Figure 16:
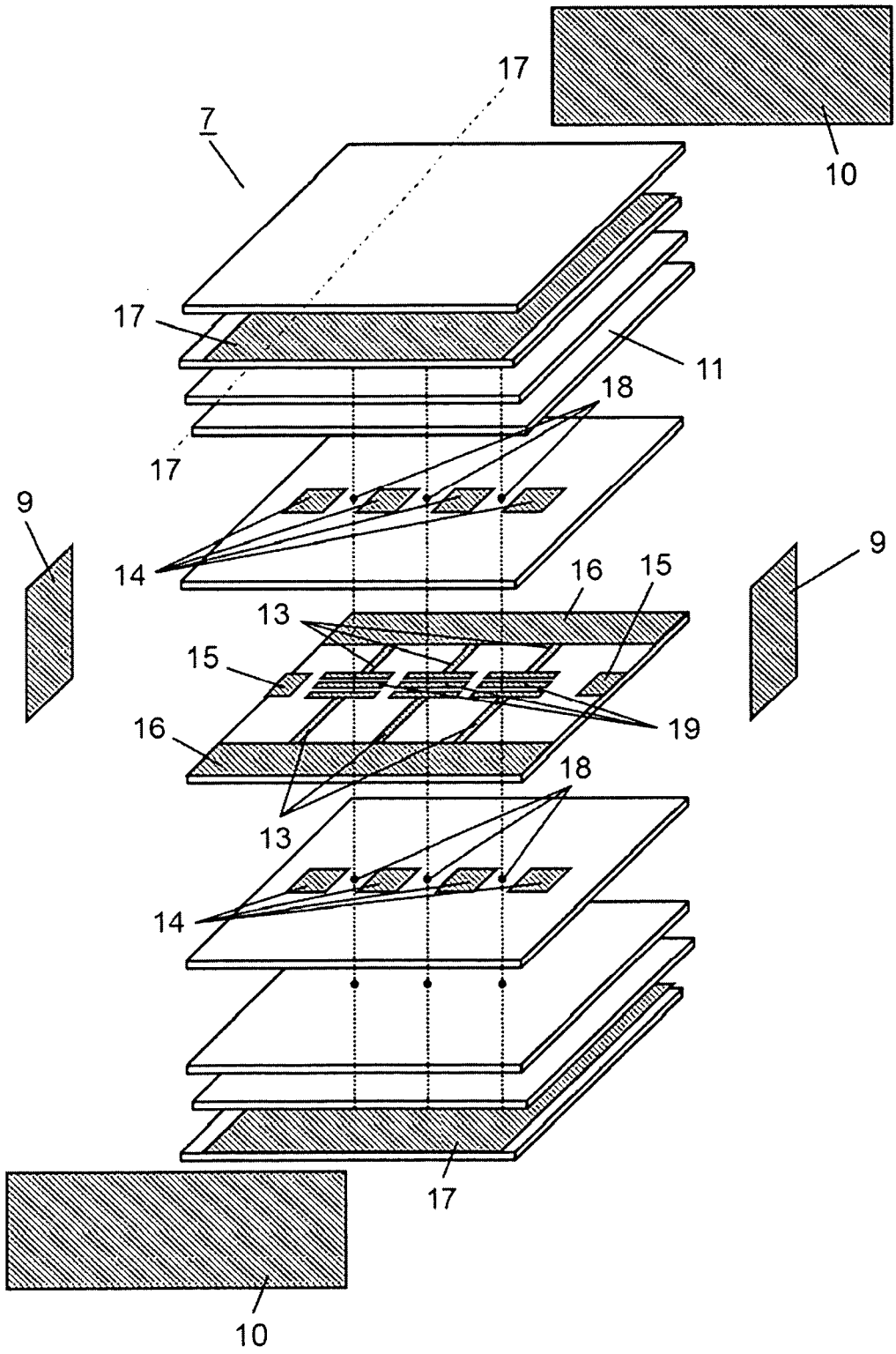
FIG. 16 is an exploded perspective view which shows a transmission line type resonator in accordance with a fourth exemplary embodiment of the present invention.

FIG. 16 shows an exploded perspective view of a transmission line type resonator of complex right hand left hand system in the fourth embodiment. The point of difference from the first embodiment is that split type line electrode 19 is used in place of line electrode 12.

Figure 17:
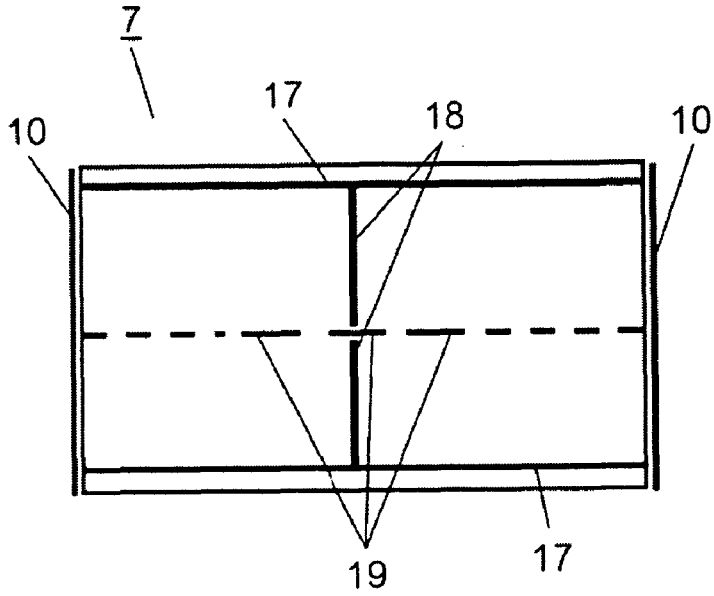
FIG. 17 shows a cross sectional view of the transmission line type resonator according to the fourth embodiment.
Figure 18:
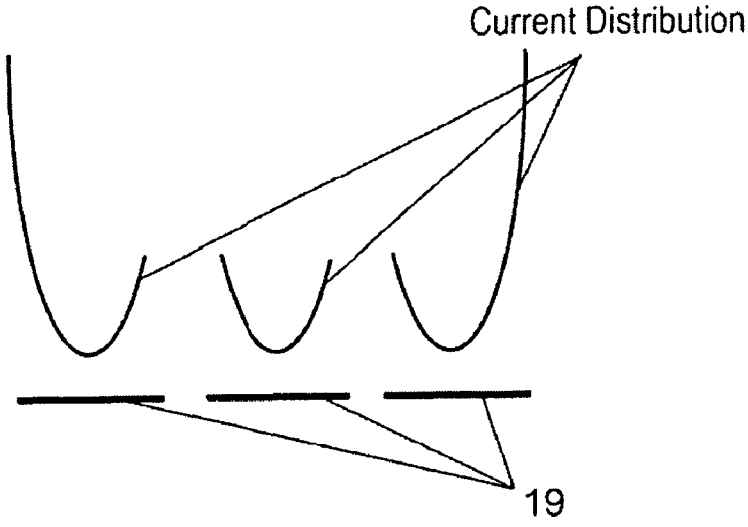
FIG. 18 is a chart showing the current distribution in the transmission line type resonator according to the fourth embodiment.

FIG. 17 shows the cross sectional view, taken along the line 17-17 of FIG. 16. FIG. 18 shows the current distribution with split type line electrode 19. The high frequency current normally concentrates at both ends of transmission line electrode. After splitting the electrode, current flows also in the electrode in the middle alleviating the current concentration. The above-described structure reduces the resistance loss in electric current, and provides a high no-load Q value.

(A Modification of the Fourth Embodiment)

Figure 19:
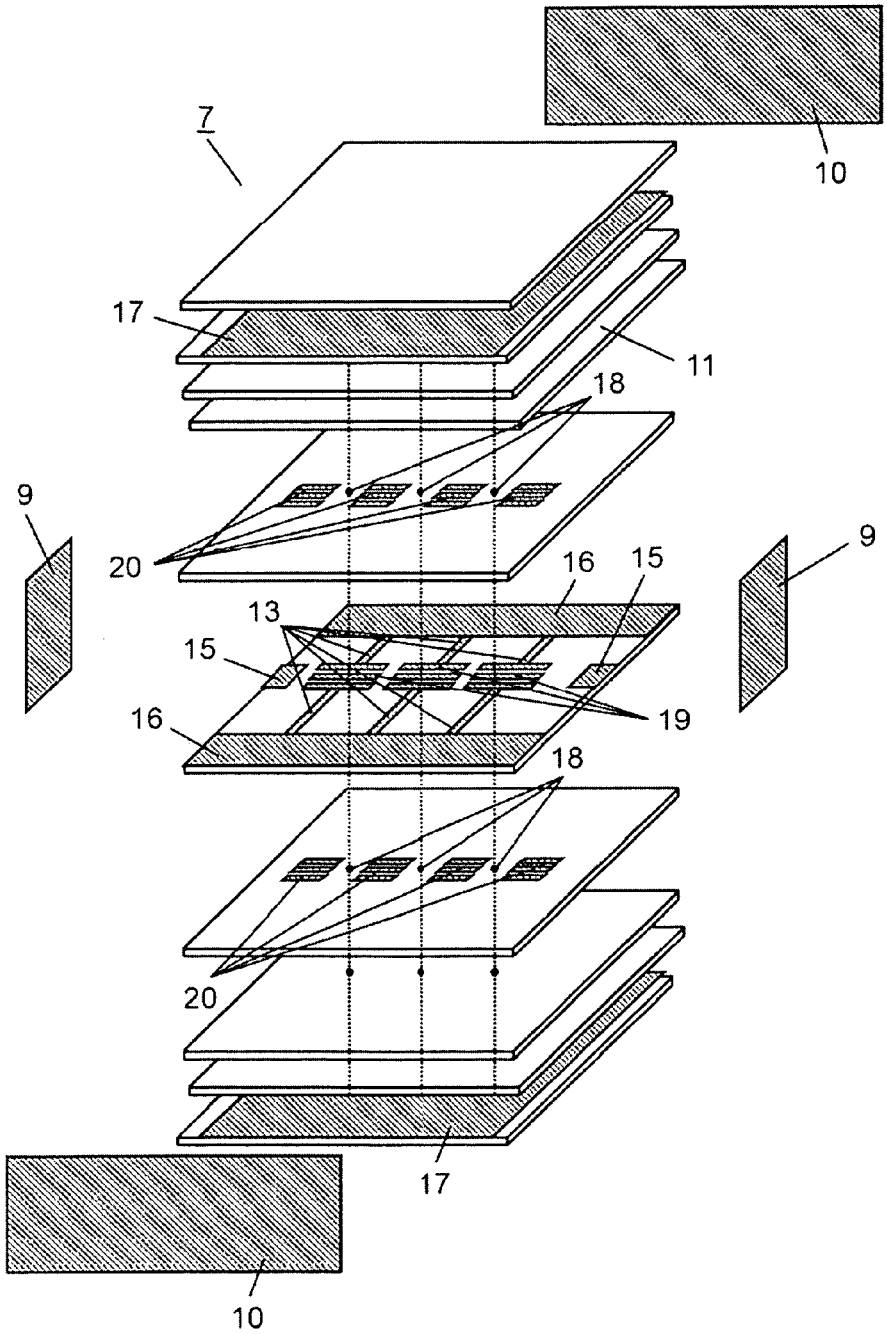
FIG. 19 is an exploded perspective view of a modification of the transmission line type resonator according to the fourth embodiment.

FIG. 19 is an exploded perspective view which shows an exemplary modification of the fourth embodiment. The point of difference from the fourth embodiment is that split type capacitance electrode 20 is used in place of capacitance electrode 14. The current concentration is alleviated also with the capacitance electrode in the present modification. So, the loss due to resistance can be lowered further.

Fifth Exemplary Embodiment

Figure 20:
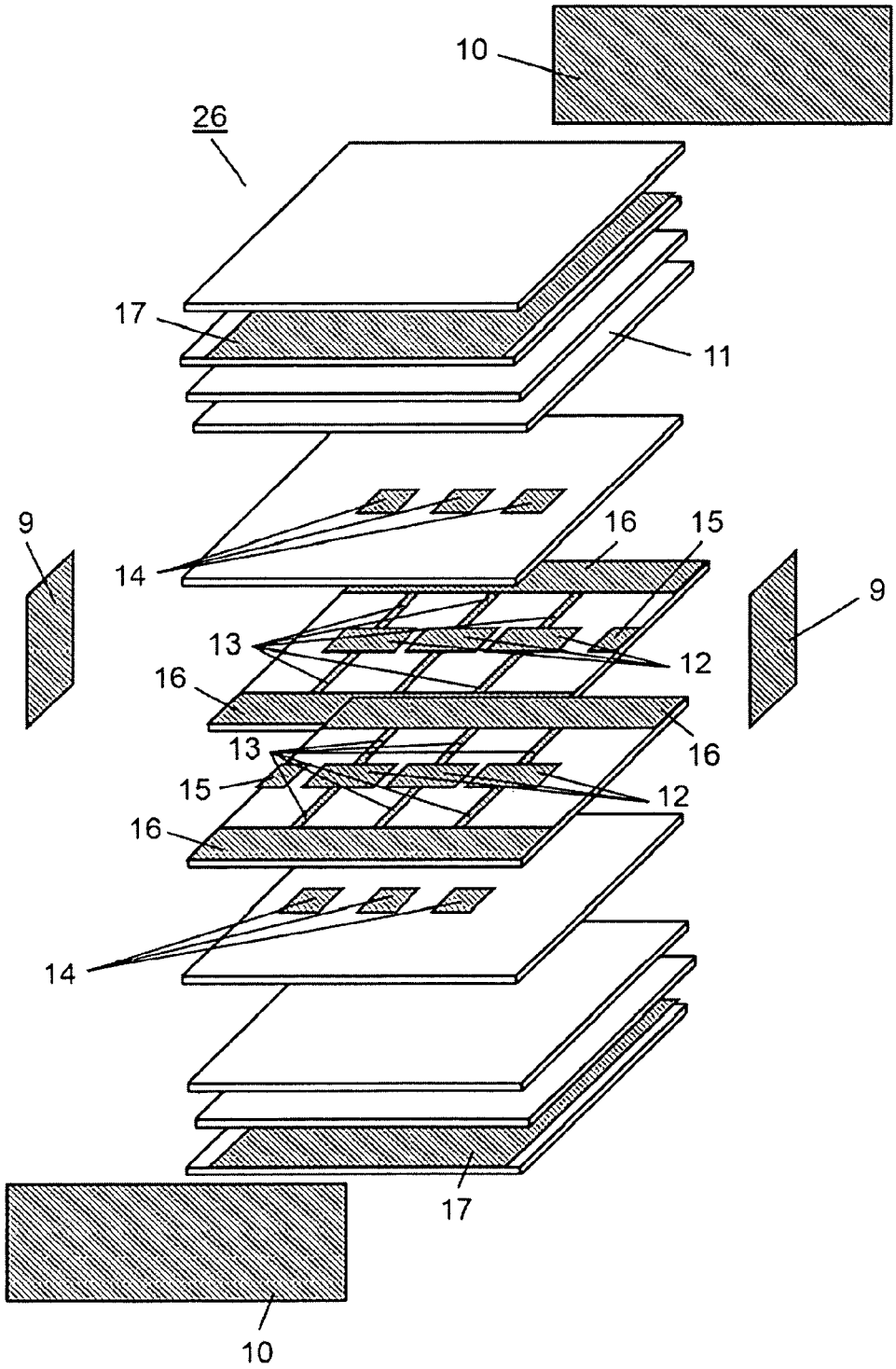
FIG. 20 is an exploded perspective view which shows a high frequency filter in accordance with a fifth exemplary embodiment of the present invention.

A high frequency filter which contains a transmission line type resonator of complex right hand left hand system is described in accordance to with a fifth embodiment of the present invention. FIG. 20 is an exploded perspective view used to show a high frequency filter which contains a transmission line type resonator of complex right hand left hand system in accordance with the fifth embodiment.

High frequency filter 26 in the present embodiment is formed of a transmission line type resonator 7 of complex right hand left hand system described in the first embodiment, with the resonator being stacked for two layers in a vertical arrangement to have the two resonators coupled by means of electromagnetic fields.

The method for coupling the resonators is not limited to the above-described, but they may be coupled using a separate coupling circuit (not shown).

The number of resonators to be coupled is not limited to two; but, three, four, five or more resonators may be stacked into multiple layers.

The appearance and function of high frequency filter 26 remain basically the same as that of FIG. 1; so, description thereof is omitted.

The above-described structure would further enhance the advantages of transmission line type resonator 7 of complex right hand left hand system described in the first embodiment, which contributes to the implementation of a compact low-loss high frequency filter.

Sixth Exemplary Embodiment

Figure 21:
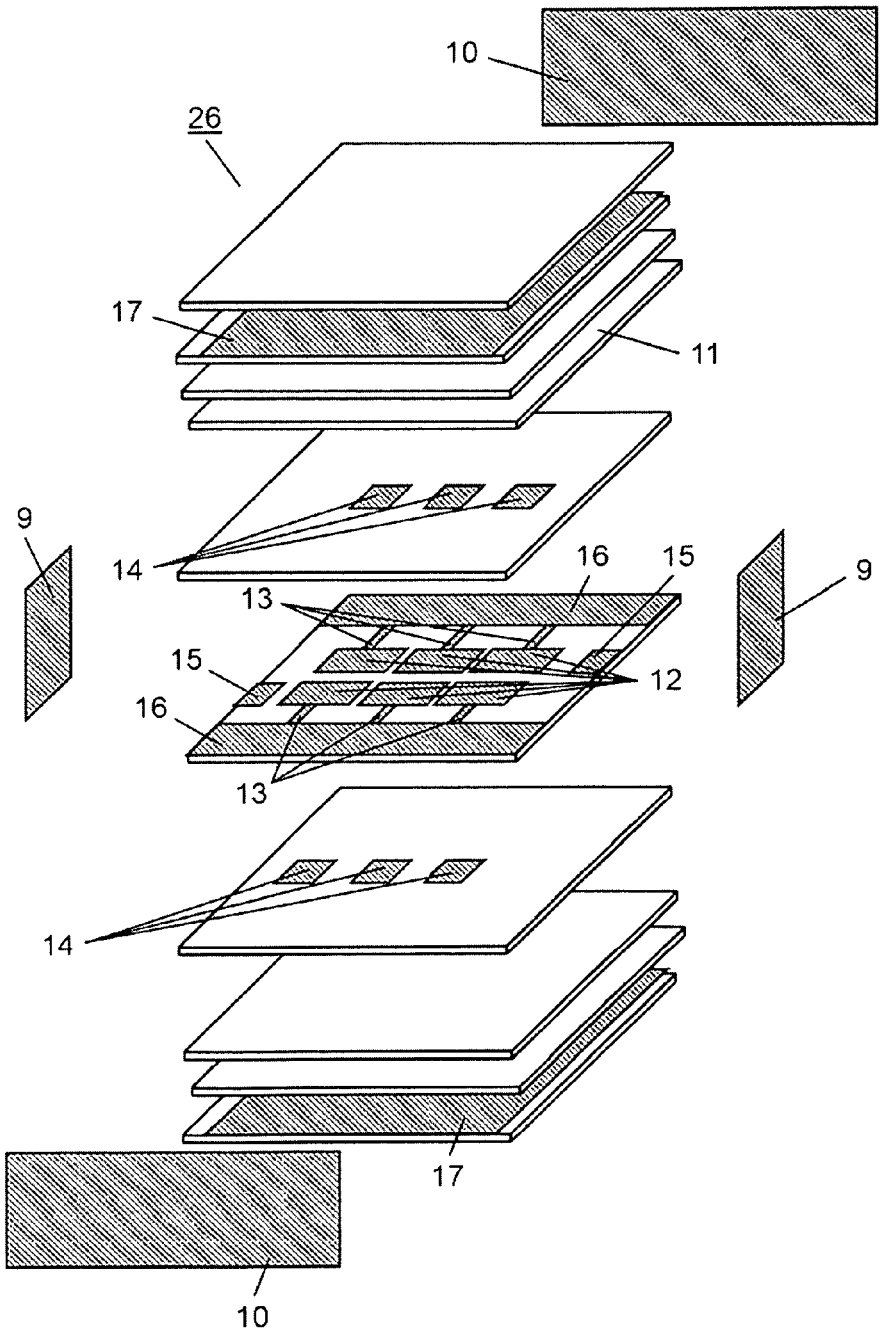
FIG. 21 is an exploded perspective view which shows a high frequency filter in accordance with a sixth exemplary embodiment of the present invention.

A high frequency filter which contains a transmission line type resonator of complex right hand left hand system is described in accordance with a sixth embodiment of the present invention. FIG. 21 is an exploded perspective view used to show a high frequency filter which contains a transmission line type resonator of complex right hand left hand system in accordance with the sixth embodiment.

High frequency filter 26 in the present embodiment is formed of a transmission line type resonator 7 of complex right hand left hand system described in the first embodiment, with the resonator being provided as two on the same plane so as they are coupled by means of electromagnetic fields. The method for coupling the resonators is not limited to the above-described; but, they may be coupled using a separate coupling circuit (not shown).

The number of resonators to be coupled is not limited to two; but, three, four, five or more resonators may be involved.

The appearance and function of high frequency filter 26 remain basically the same as that shown in FIG. 1; so, description thereof is omitted.

The above structure would further enhance the advantages of the transmission line type resonator 7 of complex right hand left hand system of the first embodiment, which contributes to the implementation of a compact and low-loss high frequency filter.

Seventh Exemplary Embodiment

Figure 22A:
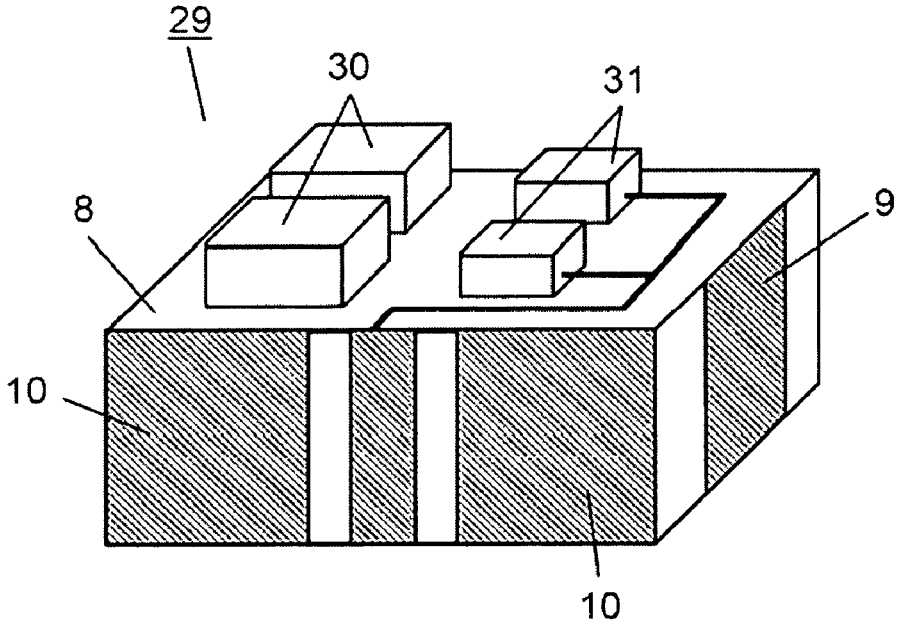
FIG. 22A shows the appearance of a high frequency module in accordance with a seventh exemplary embodiment of the present invention.
Figure 22B:
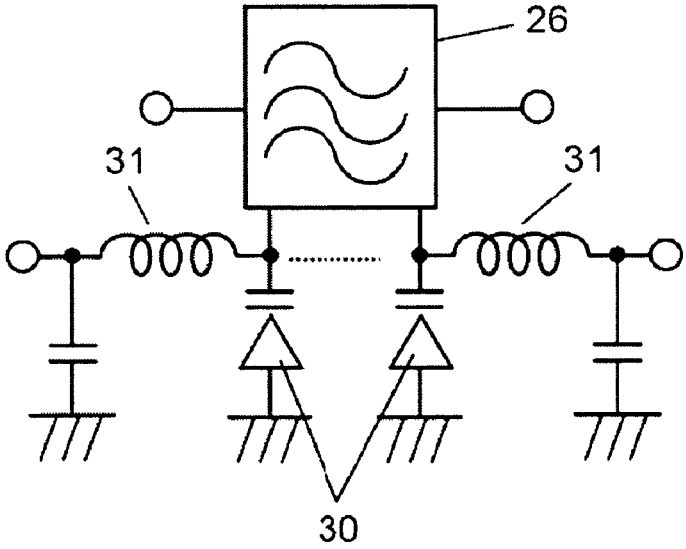
FIG. 22B shows a conceptual circuit diagram of the high frequency module according to the seventh embodiment.

A high frequency module which contains high frequency filter 26 described in the fifth and sixth embodiments of the present invention is described in accordance with the present embodiment. FIG. 22A shows the appearance of a high frequency module, and FIG. 22B shows the concept in a circuit diagram.

A tunable filter module which contains high frequency filter 26 coupled with varactor diode 30 is used here as the example of high frequency module 29.

High frequency module 29 includes high frequency filter 26, varactor diode 30 connected between high frequency filter 26 and the grounding, and chip inductor 31 connected between varactor diode 30 and a control terminal. Varactor diode 30 may be connected in a plurality with high frequency filter 26. As shown in FIG. 22A, varactor diode 30 and chip inductor 31 are mounted on the upper surface of laminate body 8.

Thus, by disposing surface mounting components on the upper surface of laminate body 8, a compact and high-performance high frequency module can be realized.

Eighth Exemplary Embodiment

Figure 23A:
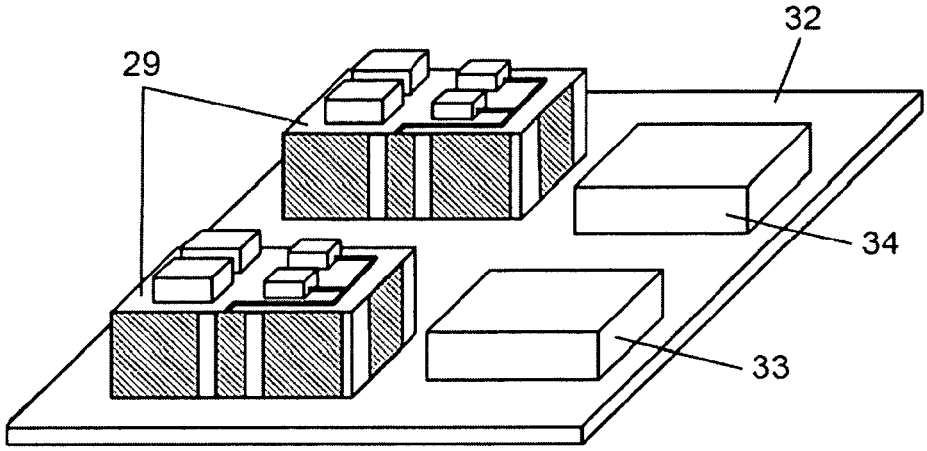
FIG. 23A shows the appearance of a wireless apparatus in accordance with an eighth exemplary embodiment of the present invention.
Figure 23B:
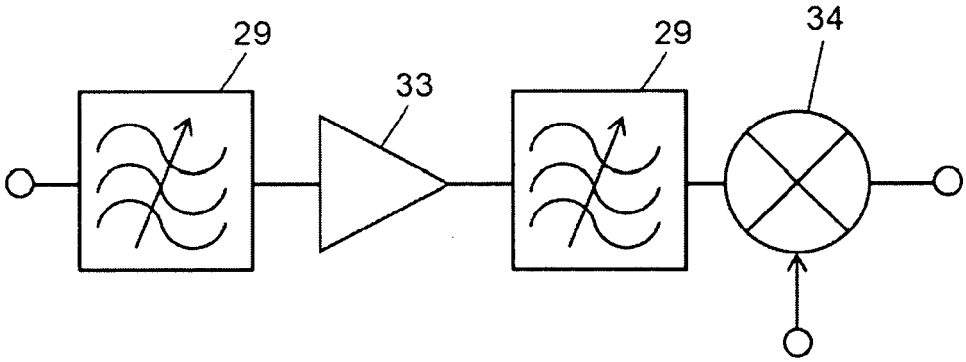
FIG. 23B shows a conceptual circuit diagram of the wireless apparatus according to the eighth embodiment.

A wireless apparatus which contains high frequency module 29 described in the seventh embodiment of the present invention is described in accordance with the present embodiment. FIG. 23A shows the appearance of the wireless apparatus, and FIG. 23B shows the concept in a circuit diagram of the wireless apparatus.

The wireless apparatus has, describing in the order starting from the input terminal side, high frequency filter 29, low-noise amplifier 33, high frequency filter 29 and mixer 34. The use of high frequency filter 29 provides for a very compact, multi-functional, high-performance wireless apparatus.

If a digital TV tuner, for example, is designed in the above-described structure, the tunable filter removes a disturbance signal of a strong electric field, and protects the low-noise amplifier and mixer from a distortion due to the disturbance signal. As the result, currents in these circuits can be reduced.

Because of its low-loss property, a transmission line type resonator in accordance with the present invention would provide substantial advantages when used in portable terminal units or the like wireless apparatus.

The invention claimed is:

1. A transmission line type resonator formed of a laminate body constituted by a plurality of dielectric sheets, comprising:

a transmission line of complex right hand left hand system provided between the plurality of dielectric sheets; and an external connection terminal provided at an end face of the transmission line type resonator, the connection terminal being connected with the transmission line of complex right hand left hand system, wherein the transmission line of complex right hand left hand system is structured of a line electrode disposed on one of the dielectric sheets, a connection pattern electrode whose line width is smaller than that of the line electrode, connected with the line electrode and formed on a same surface extending from an edge of the line electrode in a same layer in which the line electrode is formed, a grounding electrode connected with the connection pattern electrode, and an input/output pattern electrode disposed so as to make capacitive coupling with the line electrode, connected with the external connection terminal.

2. The transmission line type resonator of claim 1, wherein the line electrode is one of a plurality of line electrodes disposed on said one of the plurality of dielectric sheets, the transmission line of complex right hand left hand system is provided with a capacitance electrode which is disposed so as to be opposed to one of the line electrodes via one of the dielectric sheets placed on the plurality of line electrodes.

3. The transmission line type resonator of claim 1, the resonance mode of which is zero-order.

4. The transmission line type resonator of claim 1, wherein said one of the dielectric sheets is made of a low temperature co-fired ceramics.

5. The transmission line type resonator of claim 1, wherein said one of the dielectric sheets is made with a resin sheet.

6. The transmission line type resonator of claim 1, wherein the plurality of dielectric sheets have the same thickness.

7. The transmission line type resonator of claim 2, wherein a distance between the capacitance electrode and said one of the line electrodes is smaller than a distance between a shield pattern electrode disposed on the capacitance electrode and the capacitance electrode, or a distance between a shield pattern electrode disposed under said one of the line electrodes and said one of the line electrodes.

8. The transmission line type resonator of claim 1, wherein the connection pattern electrode has a meandering line.

9. The transmission line type resonator of claim 1, wherein the connection pattern electrode has a spiral coil.

10. The transmission line type resonator of claim 2, wherein the capacitance electrode is provided for two or more layers above and underneath the line electrode.

11. The transmission line type resonator of claim 1, wherein the line electrode is provided for a plurality of layers, each of the respective layers is shifted in location so that the line electrodes on respective layers are positioned alternating to those on each other layer.

12. The transmission line type resonator of claim 1, wherein the laminate body is constituted by a shrink-fired laminate body.

13. The transmission line type resonator of claim 1, wherein the laminate body is constituted by a non-shrink fired laminate body.

14. The transmission line type resonator of claim 1, wherein the line electrode is a split type line electrode.

15. The transmission line type resonator of claim 2, wherein the capacitance electrode is a split type capacitance electrode.

16. The transmission line type resonator of claim 1, wherein the external connection terminal is disposed on the laminate body at least at the upper surface or the lower surface.

17. A high frequency filter which contains a transmission line type resonator of claim 1.

18. A high frequency module which contains a transmission line type resonator of claim 1.

19. A wireless apparatus which contains a transmission line type resonator of claim 1.

* * * * *